US009687023B2

(12) United States Patent
Mishra et al.

(10) Patent No.: US 9,687,023 B2
(45) Date of Patent: Jun. 27, 2017

(54) MOIST SMOKELESS TOBACCO PRODUCT FOR ORAL USAGE HAVING ON A PORTION OF THE OUTER SURFACE AT LEAST ONE FRICTION REDUCING STRIP THAT PROVIDES TEXTURE DURING USE

(75) Inventors: Munmaya K. Mishra, Manakin Sabot, VA (US); Shengsheng Liu, Richmond, VA (US); William R. Sweeney, Richmond, VA (US); Feng Gao, Richmond, VA (US); Tapashi Sengupta, Barrington, IL (US)

(73) Assignee: Philip Morris USA Inc., Richmond, VA (US)

( * ) Notice: Subject to any disclaimer, the term of this patent is extended or adjusted under 35 U.S.C. 154(b) by 758 days.

(21) Appl. No.: 12/576,986

(22) Filed: Oct. 9, 2009

(65) Prior Publication Data

US 2011/0083688 A1 Apr. 14, 2011

(51) Int. Cl.
*A24B 13/00* (2006.01)
*A24B 15/18* (2006.01)

(52) U.S. Cl.
CPC ..... *A24B 13/00* (2013.01); *A24B 15/186* (2013.01)

(58) Field of Classification Search
CPC ..... A61K 9/006
See application file for complete search history.

(56) References Cited

U.S. PATENT DOCUMENTS 865,026 A 11/1907 Ellis
904,521 A 11/1908 Ellis
1,376,586 A 5/1921 Schwartz
4,513,756 A 4/1985 Pittman et al.
4,543,370 A 9/1985 Porter et al.
4,545,392 A 10/1985 Sensabaugh, Jr. et al.
4,624,269 A 11/1986 Story et al.
4,683,256 A 7/1987 Porter et al.
4,817,640 A 4/1989 Summers
4,917,161 A 4/1990 Townend
4,975,270 A 12/1990 Kehoe
5,092,352 A 3/1992 Sprinkle, III et al.
(Continued)

FOREIGN PATENT DOCUMENTS

JP 2002-501768 A 1/2002
JP 2009508523 A 3/2009
(Continued)

OTHER PUBLICATIONS

CDC, MMWR, May 21, 1999 / 48(19);398-401. http://www.cdc.gov/mmwr/preview/mmwrhtml/mm4819a3.htm (accessed Nov. 16, 2012).*

(Continued)

*Primary Examiner* — Michael J Felton
(74) *Attorney, Agent, or Firm* — Buchanan Ingersoll & Rooney PC

(57) ABSTRACT

A moist smokeless tobacco product for oral use comprises a pre-portioned piece of tobacco material semi-dissolvable, a super-hydrated membrane coating comprising a soluble, non-cross-linked component and an insoluble, cross-linked component, and a texture component. The tobacco material comprises moist smokeless tobacco. The texture component reduces the slipperiness and/or increases the friction of the moist smokeless tobacco product when placed in a user's mouth.

25 Claims, 1 Drawing Sheet

(56) References Cited

U.S. PATENT DOCUMENTS

| | | | | |
|---|---|---|---|---|
| 5,175,277 | A | 12/1992 | Rakitsky et al. | |
| 5,387,416 | A | 2/1995 | White et al. | |
| 6,162,516 | A | 12/2000 | Derr | |
| 6,325,859 | B1 | 12/2001 | De Ross et al. | |
| 7,032,601 | B2 | 4/2006 | Atchley et al. | |
| 2003/0224090 | A1 | 12/2003 | Pearce et al. | |
| 2004/0118421 | A1 | 6/2004 | Hodin et al. | |
| 2004/0118422 | A1 | 6/2004 | Lundin et al. | |
| 2004/0247649 | A1 | 12/2004 | Pearce et al. | |
| 2004/0247744 | A1 | 12/2004 | Pearce et al. | |
| 2004/0247746 | A1 | 12/2004 | Pearce et al. | |
| 2005/0003048 | A1 | 1/2005 | Pearce et al. | |
| 2005/0061339 | A1 | 3/2005 | Hansson et al. | |
| 2005/0067726 | A1 | 3/2005 | Yan et al. | |
| 2005/0100640 | A1 | 5/2005 | Pearce | |
| 2005/0244521 | A1 | 11/2005 | Strickland et al. | |
| 2006/0073190 | A1 | 4/2006 | Carroll et al. | |
| 2006/0144412 | A1 | 7/2006 | Mishra et al. | |
| 2006/0191548 | A1* | 8/2006 | Strickland et al. | 131/347 |
| 2007/0003663 | A1 | 1/2007 | Jani et al. | |
| 2007/0012328 | A1 | 1/2007 | Winterson et al. | |
| 2007/0062549 | A1 | 3/2007 | Holton, Jr. et al. | |
| 2007/0122455 | A1 | 5/2007 | Myers et al. | |
| 2007/0186844 | A1 | 8/2007 | Weisleder et al. | |
| 2007/0186941 | A1 | 8/2007 | Holton, Jr. et al. | |
| 2007/0186942 | A1 | 8/2007 | Strickland et al. | |
| 2007/0186943 | A1 | 8/2007 | Strickland et al. | |
| 2007/0186944 | A1 | 8/2007 | Strickland et al. | |
| 2007/0190157 | A1 | 8/2007 | Sanghvi et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0081071 | A1 | 4/2008 | Sanghvi et al. | |
| 2008/0173317 | A1 | 7/2008 | Robinson et al. | |
| 2008/0202533 | A1 | 8/2008 | Mishra et al. | |
| 2008/0202536 | A1 | 8/2008 | Torrence et al. | |
| 2009/0038631 | A1 | 2/2009 | Mishra et al. | |
| 2009/0196908 | A1* | 8/2009 | Lee et al. | 424/443 |
| 2009/0301505 | A1 | 12/2009 | Liu et al. | |

FOREIGN PATENT DOCUMENTS

| | | | |
|---|---|---|---|
| JP | 2009523672 | A | 6/2009 |
| JP | 2011-509090 | A | 3/2011 |
| WO | WO 91/06288 | | 5/1991 |
| WO | 99/39595 | A1 | 8/1999 |
| WO | WO 03/053175 | A | 7/2003 |
| WO | WO 2005/003178 | A1 | 1/2005 |
| WO | WO 2006/004480 | | 1/2006 |
| WO | WO 2006/065192 | | 6/2006 |
| WO | WO 2006/105173 | | 10/2006 |
| WO | WO 2008/059375 | A | 5/2008 |
| WO | 2009/087215 | A2 | 7/2009 |
| WO | 2009087215 | A2 | 7/2009 |
| WO | WO 2009/098591 | A2 | 8/2009 |
| WO | WO 2010/080599 | A1 | 7/2010 |

OTHER PUBLICATIONS

International Search Report and Written Opinion dated Sep. 17, 2008 for PCT/IB2007/004216.
International Search Report and Written Opinion dated Mar. 30, 2009 for PCT/IB2008/002883.
International Preliminary Report on Patentability and Written Opinion dated May 19, 2009 for PCT/IB2007/004216.
International Preliminary Report on Patentability issued Feb. 9, 2010 for PCT/IB2008/002883.
International Search Report and Written Opinion mailed Aug. 25, 2009 for PCT/IB2009/000385.
U.S. Appl. No. 12/790,043, filed May 28, 2010.
U.S. Appl. No. 12/748,272, filed Mar. 26, 2010.
International Preliminary Report on Patentability issued Aug. 10, 2010 for International Application No. PCT/IB2009/000385.
International Preliminary Report on Patentability issued Apr. 11, 2012 for PCT/EP2010/006101.
International Search Report and Written Opinion mailed Feb. 16, 2011 for International Application No. PCT/EP2010/006101.
Office Action issued Jan. 26, 2015 for Japanese Patent Appln. No. 2012-532486.
Office Action issued on Sep. 30, 2015, by the Japanese Patent Office in corresponding Japanese Patent Application No. 2012-532486, and an English Translation of the Office Action. (9 pages).
Decision of Granting mailed Oct. 16, 2014 for corresponding Russian Patent Appln. No. 2012118385.

* cited by examiner

MOIST SMOKELESS TOBACCO PRODUCT FOR ORAL USAGE HAVING ON A PORTION OF THE OUTER SURFACE AT LEAST ONE FRICTION REDUCING STRIP THAT PROVIDES TEXTURE DURING USE

SUMMARY

Provided is a moist smokeless tobacco product for oral use. The moist smokeless tobacco product comprises a semi-dissolvable, super-hydrated membrane coating. The semi-dissolvable, super-hydrated membrane coating comprises (a) a soluble, non-cross-linked component; and (b) an insoluble, cross-linked component. The moist smokeless tobacco product also includes one or more texture components selected from the group consisting of (a) a powder component comprising powders having at least one linear dimension of about 10 mesh to about 500 mesh included within and/or on an inner and/or an outer surface of the semi-dissolvable, super-hydrated membrane coating; (b) at least one polymer layer on an outer surface of the semi-dissolvable, super-hydrated membrane coating comprising at least one water-dissolvable coating; (c) at least one fiber, cord and/or strip within and/or on an inner and/or an outer surface of the semi-dissolvable, super-hydrated membrane coating; and (d) at least one pre-cross-linking agent for adding tackiness to the semi-dissolvable, super-hydrated membrane coating. and a shaped piece of tobacco material contained within the semi-dissolvable, super-hydrated membrane coating. Preferably, the tobacco material comprises moist smokeless tobacco. The one or more texture components reduce the slipperiness and/or increases the friction of the moist smokeless tobacco product when placed in a user's mouth. Preferably, the semi-dissolvable, super-hydrated membrane coating has a moisture content of about 10% to about 50%.

Preferably, the fibers, cords and/or strips have average dimensions ranging between about 0.01 mm and about 1.0 mm. Also, the fibers, cords and/or strips are randomly and/or uniformly oriented within, under and/or on the semi-dissolvable, super-hydrated membrane coating. The fibers, cords and/or strips are affixed to the moist smokeless tobacco product with a food-grade gum and/or gel adhesive. The fibers, cords and/or strips comprise a material selected from the group consisting of vegetable fibers, fruit fibers, tobacco fibers, herb fibers, synthetic polymers, natural polymers, and combinations thereof.

Also preferably, the at least one polymer layer is flavored or unflavored. The at least one polymer layer comprises at least one polymer selected from the group consisting of modified starch, dextrin, pullulan, pectin and combinations thereof.

In a preferred embodiment, the soluble, non-cross-linked component comprises a non-cross-linkable polymer selected from the group consisting of starch, dextrin, gum arabic, guar gum, chitosan, cellulose, polyvinyl alcohol, polylactide, gelatin, soy protein, whey protein and combinations thereof. The insoluble, cross-linked component comprises a cross-linking agent and a cross-linkable polymer selected from the group consisting of alginate, pectin, carrageenan, modified polysaccharides with cross-linkable functional groups and combinations thereof. Preferably, the cross-linkable polymer is a chemically cross-linkable polymer.

Preferably, the moist smokeless tobacco product can include at least one additive in the semi-dissolvable, super-hydrated membrane coating and/or said tobacco material. The additives are selected from the group consisting of flavorants, sweeteners, preservatives, nutraceuticals, anti-oxidants, amino acids, minerals, vitamins, botanical extracts, humectants, colorants, chemesthetic agents and combinations thereof.

The tobacco material can further comprise a supplemental amount of tobacco substitute material selected from the group consisting of fruit fibers and particles, vegetable fibers and particles, plant fibers and particles and combinations thereof to the tobacco material. Preferably, the tobacco material is completely disintegrable in the mouth. The tobacco material comprises moist smokeless tobacco having a moisture content of about 35% to about 65%. The tobacco material comprises moist smokeless tobacco having a water activity of about 0.85 aw to about 0.86 aw.

In an embodiment, the powder component comprises one or more of natural plant fibers, water-insoluble synthetic fibers, particles or fibers of water-insoluble hydrophilic biopolymers, unencapsulated tobacco powder, encapsulated tobacco powder, fine cut tobaccos, fibers or particles of silica, and dry flavor powders included within and/or on the inner and/or an outer surfaces of the semi-dissolvable, super-hydrated membrane coating. The powder component is included in an amount of about 0.01 g to about 5.0 g.

In one embodiment, the bulk density of the super-hydrated membrane coating is about 1.0±0.2 g/cm$^3$. The shaped piece of tobacco material has a length of up to about 1.5 inch, a width of up to about 0.75 inch and a height of up to about 1 inch, and the shaped of tobacco material weighs about 0.5 g to about 3.0 g.

Also provided is a method of making a moist smokeless tobacco product. The method includes shaping tobacco material into a shaped piece of tobacco material; forming a semi-dissolvable super-hydrated membrane coating comprising a soluble, non-cross-linked component; and (b) an insoluble, cross-linked component on the shaped piece of tobacco material to form a coated piece of tobacco material; and adding one or more texture components selected from the group consisting of (a) a powder component comprising powders having at least one linear dimension of about 10 mesh to about 500 mesh included within and/or on an inner and/or an outer surface of the semi-dissolvable, super-hydrated membrane coating; (b) at least one polymer layer on an outer surface of the semi-dissolvable, super-hydrated membrane coating comprising at least one water-dissolvable coating; (c) at least one fiber, cord and/or strip within and/or on an inner and/or an outer surface of the semi-dissolvable, super-hydrated membrane coating; and (d) at least one pre-cross-linking agent for adding tackiness to the semi-dissolvable, super-hydrated membrane coating and combinations thereof to form a moist smokeless tobacco product having a textured coating.

BRIEF DESCRIPTION OF THE DRAWING FIGURES

DETAILED DESCRIPTION

Figure 1:
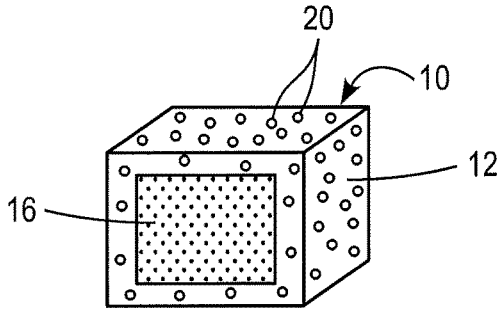
FIG. 1 is a cross-sectional view of a moist smokeless tobacco product with a semi-dissolvable, super-hydrated membrane coating having a powdered surface coating.

Moist smokeless tobacco products can include a wrapper and/or coating and an inner filling material disposed within the wrapper and/or coating. The inner filling material can comprise moist smokeless tobacco (MST). Such moist smokeless tobacco products allow the release of flavorants, juices, and/or chemesthetic components of the inner filling material by movement of saliva through the wrapper and into contact with the inner filling material, diffusion of the flavorant and/or chemesthetic components into the saliva, and movement of the saliva containing the flavorant and/or chemesthetic components to sensory organs in the oral cavity of the consumer, generally located on the tongue.

The wrappers of such moist smokeless tobacco products can be made of paper, cloth, or other porous sheet material intended to allow the movement of saliva through the wrapper, but insufficient to allow significant movement of filling material, such as tobacco shreds or particles, through the wrapper and into the mouth. However, because the saliva containing flavorant or chemesthetic components must move across the wrapper twice, the wrapper can also effectively slow the release of these components to the oral cavity of the user. This can have an adverse effect on the timing of delivery of these components, as saliva retained within the wrapper develops higher concentrations of components than it would contain if flow across the wrapper were more rapid. As a result, pouch wrappers made of paper or fabric can be found by the user to provide initial dryness, reduced flavor, and impaired circulation of saliva. In addition, some users find the surfaces of the pouch products to feel rough against the inner surfaces of the mouth.

Nevertheless, pouched products can provide desirable benefits in ease of handling, insertion/placement in the mouth, portion management, and decreased initial "gritty" mouthfeel, when compared to MST products, such as chewing tobacco, that are not contained within a wrapper. A new product having a thin, smooth, high moisture content gel coating that provides good transfer of flavorant and/or chemesthetic components from an inner filling material to the sensory organs of the mouth via the saliva would provide an alternative to a moist smokeless tobacco pouch product.

Moist smokeless tobacco products having a super-hydrated gel membrane are described in commonly owned U.S. Application Publication No. 2008/0202533 A1, the entire content of which is incorporated herein by reference. It has been discovered that super-hydrated gel membranes produced from biopolymers, while avoiding some of the disadvantages of traditional pouch materials can be perceived as too slick or slippery to the user, depending upon the water content of the gel membrane. Provided herein are portioned MST products having a textured, super-hydrated membrane coating.

The portioned MST product described herein comprises a super-hydrated membrane coating formed of one or more polymers and further comprising a texture component. Preferably, the texture component comprises one or more of: (a) a powder component comprising powders having at least one linear dimension of about 10 mesh to about 500 mesh included within and/or on an inner and/or an outer surface of the semi-dissolvable, super-hydrated membrane coating; (b) at least one polymer layer on an outer surface of the semi-dissolvable, super-hydrated membrane coating comprising at least one water-dissolvable coating; (c) at least one fiber, cord and/or strip within and/or on an inner and/or an outer surface of the semi-dissolvable, super-hydrated membrane coating; and (d) at least one pre-cross-linking agent for adding tackiness to the semi-dissolvable, super-hydrated membrane coating and combinations thereof.

As used herein, the terms "texture component," "textured component," "textured components" and "texture components" describe one or more of: (a) a powder component comprising powders having at least one linear dimension of about 10 mesh to about 500 mesh included within and/or on an inner and/or an outer surface of the semi-dissolvable, super-hydrated membrane coating; (b) at least one polymer layer on an outer surface of the semi-dissolvable, super-hydrated membrane coating comprising at least one water-dissolvable coating; (c) at least one fiber, cord and/or strip within and/or on an inner and/or an outer surface of the semi-dissolvable, super-hydrated membrane coating; and (d) at least one pre-cross-linking agent for adding tackiness to the semi-dissolvable, super-hydrated membrane coating and combinations thereof as described in detail below. Thus, the super-hydrated membrane coating of the moist smokeless tobacco product includes one or more of the texture components, which provides a less slippery surface as compared to super-hydrated membrane coating and other gel coatings without a texture component. Thus, the texture component provides increased friction, tackiness and/or roughness to the surface of the super-hydrated membrane coating.

As described herein, the one or more of: (a) a powder component comprising powders having at least one linear dimension of about 10 mesh to about 500 mesh included within and/or on an inner and/or an outer surface of the semi-dissolvable, super-hydrated membrane coating; (b) at least one polymer layer on an outer surface of the semi-dissolvable, super-hydrated membrane coating comprising at least one water-dissolvable coating; (c) at least one fiber, cord and/or strip within and/or on an inner and/or an outer surface of the semi-dissolvable, super-hydrated membrane coating; and (d) at least one pre-cross-linking agent for adding tackiness to the semi-dissolvable, super-hydrated membrane coating can be used to provide a textured surface to the super-hydrated membrane coating so that the textured super-hydrated membrane coating is not perceived as slick, shiny or slippery. However, due to the presence of the polymer in the membrane, the surface of the super-hydrated membrane coating remains relatively smooth, avoiding the roughness sometimes experienced with paper wrappers of conventional MST or pouch products. The result is a surface that is smooth, but not slick, shiny or slippery, and that is textured to develop coarseness and/or tackiness on the surface of the MST product, but does not feel rough in the mouth. Preferably, the surface of the textured, super-hydrated membrane coating appears soft, wet, organic and/or natural, and is thus appealing to users.

Moreover, the use of fibers and/or particles made of different materials (or of different sized fibers and/or different sized particles made of the same materials) can provide different textures at different locations such that the surface of the MST product have multiple textures leading to a more pleasing mouthfeel experience for the user. In addition, the fibers and/or particles may contain flavorants, which are released rapidly to the saliva due to the location of the fibers and/or particles at or near the surface of the membrane.

Preferably, the pre-portioned MST product having a textured super-hydrated membrane coating is prepared from a multi-component polymer solution. In a preferred embodiment, a monolayer, textured, super-hydrated membrane coating can be used to enclose a portion of moist smokeless tobacco by coating the tobacco with a two polymer solution and a texture component in a single layer. In other embodiments, the textured, super-hydrated membrane coating can include two or more layers. For example, the first layer can include the super-hydrated membrane coating. A powder and/or particle coating, fibers, cords and/or strips and/or a second water-dissolvable coating can then be added to the coated tobacco product to create surface texture and form a second layer. Alternatively, the super-hydrated membrane coating can be pre-crosslinked by including a pre-cross-linking agent in the coating solution to provide surface texture. Preferably, the single or multi-layer textured, super-hydrated membrane coating is thin, provides high moisture and good strength to maintain a cohesive product during use, and reduces slipperiness as compared to coatings not including a texture component.

FIG. 1 illustrates a cross-sectional view of one embodiment of a moist smokeless tobacco product 10 with a textured super-hydrated membrane coating 12. The textured super-hydrated membrane coating 12 includes a first layer comprising a bicomponent coating that coats a portion of tobacco material 16. The bicomponent coating 12 includes a soluble polymer and an insoluble polymer, which may be the same or different polymer. The first layer can also include a texture component. In other embodiments, the textured super-hydrated membrane coating also includes a second layer comprising a texture component, which may be the same or different from the texture component added to the first layer.

Preferably, the tobacco material 16 is a molded portion of moist smokeless tobacco (also known as moist snuff tobacco). In this embodiment, the texture component is in the form of a powder component 20 that can be incorporated in the super-hydrated membrane coating, placed under the super-hydrated membrane coating or form a second layer on at least a portion of the surface of the super-hydrated membrane coating 12.

Preferably, the moist smokeless tobacco product 10 is sized and configured to fit comfortably between the user's cheek and gum. The moist smokeless tobacco product 10 may be formed in many shapes including, without limitation, spheres, rectangles, oblong shapes, crescent shapes, ovals, and cubes. In a preferred embodiment, the coated tobacco product is rectangular and weighs about 2.5 g to 3.0 g.

The textured super-hydrated membrane coating 12 preferably creates a porous network of an insoluble polymer after the soluble component dissolves in a user's mouth. Preferably, the first component is a soluble component that dissolves rapidly in a user's mouth such that the second component, which is preferably the insoluble component, remains intact throughout use of the tobacco product.

Preferably, the soluble component is formed by a non-cross-linkable polymer. Also preferably, the insoluble component is formed by a chemically, cross-linkable polymer reacted with a cross-linking agent.

The polymers of the soluble component and insoluble component may be natural or synthetic. Preferably the polymers are hydrocolloids. More preferably, the polymers are polysaccharides.

In a preferred embodiment, the cross-linking agent is a monovalent metal ion salt or bivalent metal ion salt.

Suitable non-chemically-cross-linkable polymers include, without limitation, starch, dextrin, gum arabic, guar gum, chitosan, cellulose, polyvinyl alcohol, and polylactide.

Suitable chemically, cross-linkable polymers include, without limitation, alginate, pectin, carrageenan, and modified polysaccharides with crosslinkable functional groups. The preferred cross-linkable polymer is alginate.

While, both monovalent and bivalent metal ion salts may be used, preferably a bivalent metal ion salt is used. Suitable bivalent metal ion salts include, without limitation, calcium lactate and calcium chloride. Calcium lactate is preferred since it is approved for use in food products.

Alternatively, proteins, such as gelatin, zein, soy protein, rice protein, and whey protein, can be used to supplement or replace the cross-linkable polymers that are cross-linked with monovalent and bivalent metal ion salts. The proteins slowly cross-link with phenolics and/or aldehydes that are naturally occurring in plant material.

Once the soluble component of the coating dissolves, pores are created in a polymer network through which the tobacco juices and flavors flow. Flavors and water are released into the user's mouth as the soluble component of the coating dissolves. The tobacco flavors and juices are then released through the pores so that the flavor experience is seamless from beginning to end. In a preferred embodiment, the bulk density of the coated tobacco product is about $1.0 \pm 0.2$ g/cm$^3$.

Preferably, the pores, created when the soluble component of the coating dissolves, are large enough to allow the unencumbered flow of juices, while remaining small enough to prevent shreds or particles of tobacco from traveling through the pores and into the user's mouth.

In a preferred embodiment, the super-hydrated membrane coating including the texture component encloses a pre-portioned tobacco material 16. Also, the super-hydrated coating allows the tobacco juices and flavors to leach out of the coating, while still remaining intact to hold the tobacco within the coating through the duration of tobacco use. The super-hydrated coating provides a soft compliant feel to the tongue and mouth tissues, while the texture component reduces slipperiness and/or increases friction in the mouth.

Because the soluble component of the textured super-hydrated coating dissolves quickly, the sensory experience associated with moist smokeless tobacco use is rapid and unencumbered.

Once the soluble component of the textured super-hydrated membrane coating 12 dissolves or disintegrates, additional moisture and/or flavors are released into the user's mouth. Thereafter, the flavors and tobacco juices pass through the coating to provide an uninterrupted flavor experience to the user.

In a preferred embodiment, the textured super-hydrated membrane coating 12 may be provided with a desired rate of dissolution of the soluble component of the coating by altering the proportion of the soluble component to the insoluble component. For example. by using more of the soluble component, the super-hydrated membrane coating can be made more porous than coatings having less of the soluble component therein.

In another embodiment, the textured super-hydrated membrane coating 12 includes flavors, sweeteners, and/or a chemesthesis agent. The flavors, sweeteners and chemesthesis agents can be released upon dissolution of the soluble component of the textured super-hydrated membrane coating. If slow release of certain flavor additives is desired, such additives can be incorporated in the insoluble component. Preferably, the released flavors enhance the oral sensorial experience of the tobacco product user.

Preferably, the final moist smokeless tobacco product 10 weighs about 2.5 to 3.0 grams. The weight is predominately based on the amount of tobacco material used since the weight of the textured super-hydrated membrane coating is small as compared to that of the tobacco material contained therein. In an embodiment, the pre-portioned moist smokeless tobacco product may be up to about 1.5 inches long, up to 1 inch in height, and up to ¾ inch in width. Preferably, the moist smokeless tobacco product 10 is flexible, compressible, and capable of conforming to the shape of the oral cavity.

Exemplary tobacco materials 16 that may be coated with a textured super-hydrated membrane coating can include cut or ground tobacco. The tobacco can have the composition and attributes of conventional moist smokeless tobacco (also known as moist snuff tobacco).

Examples of suitable types of tobacco materials 16 that may be used include, but are not limited to, flue-cured tobacco, air-cured, Burley tobacco, Maryland tobacco, Oriental tobacco, rare tobacco, specialty tobacco, reconstituted tobacco, agglomerated tobacco fines, blends thereof and the like. Preferably, the tobacco material 16 is pasteurized. Some or all of the tobacco material 16 may be fermented.

The tobacco material 16 may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the life. Genetically modified tobacco may also be used.

Additionally, the tobacco material may also include a supplemental amount of vegetable or plant fibers or particles, such as particles of shreds of lettuce, cotton, flax, beet fiber, cellulosic fibers, blends thereof and the like.

In one embodiment, the tobacco material is completely disintegrable so that once the soluble component of the coating dissolves and tobacco material has disintegrated, a user may chew and ingest the remaining insoluble component of the super-hydrated membrane coating so that nothing remains in the user's mouth.

Preferably, the tobacco material comprises a majority amount of moist smokeless tobacco having a moisture content of about 35% to about 65% and/or a water activity of about 0.85 aw to about 0.86 aw.

In an embodiment, additives, such as flavorants, sweeteners, preservatives, nutraceuticals, antioxidants, amino acids, minerals, vitamins, botanical extracts, humectants, colorants and/or chemesthetic agents, can be included in the coating or within the tobacco material.

Suitable flavorants include, but are not limited to, any natural or synthetic flavor or aroma, such as tobacco, smoke, menthol, peppermint, spearmint, chocolate, licorice, citrus, gamma octalactone, vanillin, ethyl vanillin, breath freshener flavors, cinnamon, methyl salicylate, linalool, bergamot oil, geranium oil, lemon oil, ginger oil, pomegranate, acai, raspberry, blueberry, strawberry, wolfberry, gooseberry, sea buckthorn, acai, pomegranate, boysenberry, cranberry, bourbon, scotch, whiskey, cognac, hydrangea, lavender, apple, peach, pear, cherry, plum, orange, lime, grape, grapefruit, butter, rum, coconut, almond, pecan, walnut, hazelnut, French vanilla, macadamia, sugar cane, maple, cassis, caramel, banana, malt, espresso, kahlua, white chocolate, clove, cilantro, basil, oregano, garlic, mustard, nutmeg, rosemary, thyme, tarragon, dill, sage, anise, fennel, jasmine, coffee, olive oil, sesame oil, sunflower oil, balsamic vinegar, rice wine vinegar, or red wine vinegar. Other suitable components may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Suitable sweeteners include, without limitation water soluble sweeteners, such as monosaccharides and disaccharides, such as xylose, ribose, sucrose, maltose, fructose, glucose and/or mannose. Polysaccharides may also be included, as well as sugar alcohols and non-nutritive sweeteners.

Suitable chemesthetic agents include, but are not limited to, capsaicin, tannins, mustard oil, wintergreen oil, cinnamon oil, allicin, quinine, citric acid, and salt.

Suitable vitamins include, without limitation, vitamin A (retinol), vitamin D (cholecalciferol), vitamin E group, vitamin K group (phylloquinones and menaquinones), thiamine (vitamin $B_1$), riboflavin (vitamin $B_2$), niacin, niacinamide, pyridoxine (vitamin $B_6$ group), folic acid, choline, inositol, vitamin $B_{12}$ (cobalamins), PABA (para-aminobezoic acid), biotin, vitamin C (ascorbic acid), and mixtures thereof. The amount of vitamins can be varied according to the type of vitamin and the intended user of the pre-portioned product. For example, the amount of vitamins may be formulated to include an amount less than or equal to the recommendations of the United States Department of Agriculture Recommended Daily Allowances. Absorption of the vitamins (particularly vitamin E and certain cobalamins) by the tissues of the mouth can be enhanced through the inclusion of agents that increase permeability of mucus membranes. Suitable agents includes fatty acids (e.g., oleic, palmitic and/or lauric acid).

As used herein, the term "nutraceuticals" refers to any ingredient in foods that has a beneficial effect on human health. Nutraceuticals include particular compounds/compositions isolated from natural food sources and genetically modified food sources. For example, nutraceuticals include various phytonutrients derived from natural plants and genetically engineered plants.

Suitable minerals include, without limitation, calcium, magnesium, phosphorus, iron, zinc, iodine, selenium, potassium, copper, manganese, molybdenum, chromium, and mixtures thereof. The amount of minerals incorporated into the pre-portioned moist smokeless tobacco product can be varied according to the type of mineral and the intended user. For example, the amount of minerals may be formulated to include an amount less than or equal to the recommendations of the United States Department of Agriculture Recommended Daily Allowances. In an embodiment, minerals, such as iron and manganese can be chelated with polyphosphates or EDTA to reduce their tooth staining potential.

Suitable amino acids include, without limitation, the essential amino acids that cannot be biosynthetically produced in humans, including valine, leucine, isoleucine, lysine, threonine, tryptophan, methionine, and phenylalanine. Examples of other suitable amino acids include the non-essential amino acids including alanine, arginine, asparagine, aspartic acid, cysteine, glutamic acid, glutamine, glycine, histidine, proline, serine, and tyrosine.

In another embodiment, the pre-portioned moist smokeless tobacco product can include various active agents having antioxidant properties that can delay the ageing process, as food-grade ingredients. For example, the antioxidants can include: active ingredients that can be extracted from *Ginkgo biloba*, including flavonoid glycosides ("ginkgoflavonoids"), such as (iso)quercitin, kaempferol, kaempferol-3-rhamnosides, isorhamnetin, luteolin, luteolin glycosides, sitosterol glycosides, and hexacyclic terpene lactones, referred to as "ginkgolides" or "bilobalides"; the active ingredients that can be extracted from *Camellia sinensis*, such as green tea, including various "tea tannins," such as epicatechol, epigallocatechol, epigallocatechol gallate, epigallocatechol gallate, theaflavin, theaflavin monogallate A or B, and theaflavin digallate; the active ingredients that can be extracted from *Vaccinium myrtillus*, such as blueberry, including at least 15 different anthocyanosides, such as delphinidin, anthocyanosides, myrtin, epimyrtin, phenolic acids, glycosides, quercitrin, isoquercitrin, and hyperoside; the active ingredients that can be extracted from *Vinis vitifera Olea europensis*, such as the leaves of olive trees, include oleuropein. Many active ingredients identified from these and other plant sources associated with the neutralization of free radicals and useful for delaying the ageing process are contemplated as suitable for inclusion in the pre-portioned moist smokeless tobacco product described herein.

Suitable botanical extracts can include the active ingredients of *Trifolium pratense*, such as purple clovers (i.e., common purple trefoils), including isoflavones or isoflavone glucosides, daidzein, genestein, formononentin, biochanin A, ononin, and sissostrin. The health-promoting properties of compounds derived from *Panax*, a genus that includes Ginseng, are well-established and may also be included in the pre-portioned moist smokeless product. These and other botanicals, botanical extracts, and bioactive compounds having health promoting effects are contemplated.

Suitable preservatives include, without limitation, methyl paraben, propyl paraben, sodium propionate, potassium sorbate, sodium benzoate and the like. The preservatives can be included in an amount of about 0.001 wt % to about 20 wt %, and more preferably about 0.01 wt % to about 1.0 wt % (e.g., about 0.1 wt %), based upon the total weight of the moist smokeless tobacco product.

Humectants can also be added to the tobacco material and/or coating to help maintain the moisture levels in the oral tobacco product. Examples of humectants that can be used with the tobacco material and/or coating include glycerol and propylene glycol. It is noted that the humectants can also be provided for a preservative effect, as the water activity of the product can be decreased with inclusion of a humectant, thus reducing opportunity for growth of microorganisms. Additionally, humectants can be used to provide a higher moisture feel to a drier tobacco component.

In a preferred embodiment, the first layer of the textured super-hydrated membrane coating is created via ionic cross-linking (outward-to-inward cross-linking1021238). Preferably, one or more polymers are used to create the thin membrane, super-hydrated coating over a portion of a tobacco material.

In another embodiment, the first layer of the textured super-hydrated membrane coating is created via ionic cross-linking (inward to outward cross-linking). Preferably, one or more polymers are used to create the thin membrane, super-hydrated coating over a portion of a tobacco material.

In a preferred embodiment, a multi-component polymer coating containing at least two polymers is used so that the properties of the textured super-hydrated membrane coating, such as the rate of dissolution and the size and amount of pores in the coating, can be controlled.

The size of the pores, created when the soluble component dissolves, may be altered by patterning the coating in such a way as to ensure the soluble component is only in certain spots and in certain amounts so that once the soluble component dissolves away the pores are of a desired size and in a desired location.

In the preferred embodiment, a portion of tobacco material 16 is shaped. The tobacco material may be molded in any shape to create a preform. The tobacco material is preferably pressed or molded in a manner that does not remove moisture from the tobacco, e.g., for MST, using light pressure to maintain about 35% to 65% moisture content of the tobacco material and/or a water activity of about 0.85 aw to about 0.86 aw. The moist smokeless tobacco can be molded in a large enough shape to provide moist smokeless tobacco users with a desired mouth feel of the product. Alternatively, the shaping of the tobacco material can be accomplished by continuous low shear extrusion and cutting of the shapes with or without subsequent forming and/or shaping.

In an embodiment, the tobacco material is then dipped in a polymer solution containing at least two different polymers dissolved in water. In some embodiments, the polymer solution can include extracts and/or juices, such as tobacco extracts. Preferably, a chemically cross-linkable polymer and a non-cross-linkable polymer are used.

In a preferred embodiment, the concentration of the film forming polymer solution is about 0.5 wt % to 20 wt % polymer in the solution. Most preferably, the concentration of the film forming polymer solution is about 1 wt % to 1.5 wt % of the polymer components with the balance being water.

The concentration of the polymer solution determines the thickness of the coating membrane. The thickness of the coating can in turn affect how quickly the soluble component of the coating dissolves in a user's mouth. The coating is a moist, gel-like coating when formed and the moistness is preferably retained until use. Preferably, the coated moist smokeless tobacco product is hermetically sealed in suitable packaging to prevent moisture in the tobacco and coating from evaporating.

If the coating is peeled off of the tobacco product and completely dried, the coating is preferably about 0.02 mm to 1.0 mm thick. More preferably, when the coating is completely dried, it is about 0.08 mm to 0.14 mm thick. In a most preferred embodiment, the coating when completely dried is about 0.11 mm thick. It should be noted that the coating is not intended to be dried, but rather retains a high moisture content.

In a preferred embodiment, the weight of the coating when completely dried is about 0.01 g to about 0.1 g for a coated moist smokeless tobacco product weighing about 2.5 g. More preferably, the weight of the coating when completely dried is about 0.013 g for a coated moist smokeless tobacco product weighing about 2.5 g. In contrast, the weight of the coating for a coated moist smokeless tobacco product weighing about 2.5 g, when the coating is at the preferred moisture content is about 0.1 g to about 0.2 g, more preferably about 0.15 g.

After coating the tobacco material 16 with the film forming polymer solution, cross-linking is conducted with a cross-linking solution including a monovalent metal ion salt or a bivalent metal ion salt.

Preferably, the cross-linking solution contains a bivalent metal ion salt. Most preferably, the cross-linking solution includes calcium lactate, which is commonly used in the food industry. In one embodiment, the cross-linking solution is a 2.0 wt % calcium lactate solution. Using less than 0.5 wt % cross-linking agent will generally not provide enough cross-linking agent to react with the amounts of cross-linkable polymer included in the coating mixture, which tends to result in a weak coating that will not provide the pre-portioned product with sufficient structural integrity for user handling when retrieving the product and positioning it in the oral cavity. Using more than about 2.0 wt % is unnecessary due to the low amount of cross-linkable polymer present, thereby adding unnecessary cost to the product, and may adversely affect the flavor of the product.

Alternatively, proteins, such as gelatin, zein, soy protein, rice protein, and whey protein, can be used to supplement and/or replace the cross-linkable polymers that are cross-linked with monovalent and bivalent metal ion salts. The proteins slowly cross-link with phenolics and/or aldehydes that are naturally occurring in plant material.

When the gel is applied, its liquid content includes water and/or flavored juices and/or extracts, such as tobacco extracts. After application, the gel is dried or conditioned during manufacture to reduce the water activity of the gel to a point that is non-conducive to the growth of microbes. During the drying process, the pure water evaporates from the gel and is replaced via diffusion with liquid from the moist tobacco. For example, when dried, juices from the plant material (including water soluble flavors and compounds from the plant material) transfer (e.g., by diffusion) into and permeates the gel coating. When the product is placed in the mouth, the extracts and juices that permeate the gel coating are released into the user's saliva through syneresis, dissolution, and/or diffusion so as to provide an immediate burst of flavor as opposed to slow, delayed flavor release.

In a preferred embodiment, when drying, the moist smokeless tobacco product 10 is exposed to air or patted dry to evaporate excess moisture. In other embodiments, the moist smokeless tobacco product can be dried in a convection oven. Preferably, the convention oven is heated to about 60° C. and care is taken so that the final moist smokeless tobacco product retains about 35% to about 65% moisture. If not dried, the coating may be watery.

By using both a non-cross-linkable polymer and a cross-linkable polymer, the porosity and strength of the super-hydrated membrane coating can be controlled. For instance, the dissolution rate of the resulting super-hydrated membrane coating 12 can be altered by modifying the specific proportion of cross-linked to non-cross-linked polymers. In a preferred embodiment, the coating contains 10 to 90 wt % of the cross-linked polymer. Preferably, the proportion of cross-linked polymer in the coating is 60 to 70 wt %.

In another embodiment, the polymer solution and the cross-linking solution can be patterned, overprinted, or sprayed onto the tobacco material preform to form a network having a soluble component and an insoluble component. The polymer solution may include a chemically, cross-linkable polymer and a non-cross-linkable polymer. Alternatively, the polymer solution may include a single chemically, cross-linkable polymer. When a single polymer is used, the cross-linking solution may be selectively sprayed to leave some portions of the coating non-cross-linked and soluble. The soluble component of the coating may dissolve, leaving a porous network of insoluble component in place to maintain coherence of the tobacco material 16, while allowing the free flow of saliva in the user's mouth.

In an embodiment, the process may be automated. For instance, the coating step may occur via spraying the polymer solution and the cross-linking solution alternately onto a preformed portion of tobacco material 16 to create a cross-linked, thin, super-hydrated membrane coating 12 of a desired thickness.

In an embodiment, tobacco-based polymers may be substituted for non-tobacco sourced materials in the coating. Flavorful tobacco compounds may be extracted from the tobacco based material in order to modify the tobacco flavor character to initial in-mouth experience. However, such extraction is unnecessary.

In one embodiment, additional dissolvable tobacco such as tobacco extracts or colloidal encapsulated tobacco can be added to the coating to increase the initial tobacco flavor in the first stages of the dissolution of the super-hydrated membrane coating. The encapsulated tobacco having dimensions ranging in size from about 500 mesh to about 10 mesh can be used as a powder component 20 as described above.

Fillers may be added to the coating to make the coating opaque. Colorants and/or opacifiers may also be added to alter the color of the coating.

The following examples are exemplary and are not meant to limit any aspects of the embodiments disclosed herein.

EXAMPLE 1

To form a super-hydrated membrane coating by ionic cross-linking of two biopolymers, a round bottom flask was charged with 1.0 g alginate, 0.5 g starch and 98.5 mL of deionized water. The mixture was stirred and heated to about 50° C. to 100° C. to dissolve the biopolymers The solution was cooled down to room temperature and then transferred to a plastic pan. 2.5 g of moist smokeless tobacco was first molded into a rectangular shape and then dipped into the above described solution. A cross-linking solution of 2.0 wt % calcium lactate in water was prepared. The coating on the moist smokeless tobacco was then cross-linked with the 2.0 wt % cross-linking solution. The sample was exposed in air to evaporate moisture until the weight of the coated moist smokeless tobacco product reached about 2.5 g to 2.8 g.

EXAMPLE 2

To form a super-hydrated membrane coating by ionic cross-linking of two biopolymers, a round bottom flask was charged with 1.0 g alginate, 0.5 g gum arabic and 98.5 mL of deionized water. The mixture was stirred and heated to about 50° C. to 100° C. to dissolve the biopolymers. The solution was cooled down to room temperature and then transferred to a plastic pan. A cross-linking solution of 2.0 wt % calcium lactate in water was created. 2.5 g of moist smokeless tobacco was first molded into a rectangular shape and then dipped into the above described solution. The coating on the moist smokeless tobacco was then cross-linked with the 2.0 wt % cross-linking solution. The sample was exposed in air to evaporate moisture until the weight of the coated moist smokeless tobacco product reached about 2.5 g to 2.8 g.

EXAMPLE 3

To form a super-hydrated membrane coating by ionic cross-linking of two biopolymers, a round bottom flask was charged with 1.0 g alginate, 0.5 g soy protein and 98.5 mL of deionized water. The mixture was stirred and heated to about 50° C. to 100° C. to dissolve the biopolymers. The solution was cooled down to room temperature and then transferred to a plastic pan. A cross-linking solution of 2.0 wt % calcium lactate was prepared. 2.5 g of moist smokeless tobacco was first molded into a rectangular shape and then dipped into the above described biopolymer solution. The coating on the moist smokeless tobacco was then cross-linked with the 2.0 wt % cross-linking solution. The sample was exposed in air to evaporate moisture until the weight of the coated moist smokeless tobacco product reached about 2.5 g to 2.8 g.

Prior to drying, a texture component can be added to the moist smokeless tobacco product. Alternatively, the texture component can be added to the moist smokeless tobacco product during formation of the super-hydrated membrane coating or after drying as described in detail below.

In a first embodiment, as shown in FIG. 1, the texture component in the form of the powder component 20 is added to the moist smokeless tobacco product 10. In a preferred embodiment, the powders and/or particles range in size from about 500 mesh to about 10 mesh. In one embodiment, the powder component 20 can be disposed under, within or on an outer surface of a first and/or a second layer of super-hydrated membrane coating 12 in an amount of about 0.01 g to about 5.0 g. Preferably, the powder component 20 comprises particles, either powders or granules or combinations of these. In an embodiment, the powder can be applied to the outer surface of the super-hydrated membrane coating, e.g., by distributing powders, fibers, or granulated solids across the surface of a wet, newly cast membrane and allowing the membrane to continue to solidify. However, in other embodiments, the powder can be mixed into the coating solution and applied as part of the super-hydrated membrane coating 12. In an embodiment, the powder component 20 can be included in the super-hydrated membrane coating.

The particles that form the powder component 20 can be individual particles of a powder, or may be granulated solids held together by, e.g. a binder, depending upon the size of the particles and the degree of texturing or roughness desired in the membrane surface. If the composite membrane is formed by in-situ coating of the inner filling material 16, the resulting moist smokeless tobacco product 10 can have a moist, organic appearance, which appeals to many users of traditional MST products.

Preferably, the powders used to provide texture to the membrane surface can include materials such as natural plant fibers, dietary fibers (e.g., Fibrex 605, Citri-Fi Series 100; 200; 100 FG; 200 FD, and other vegetable and fruit fibers), biopolymers including agar, starch and starch derivatives, cellulose and cellulose derivatives (e.g., wood based celluloses and other plant based celluloses and derivatives thereof), chitosan, chitin, and/or other natural proteins, water-insoluble synthetic fibers, tobacco dust, encapsulated tobacco dust, fine cut tobaccos, fibers or particles of silica, dry flavor powders, in particular water-insoluble dry flavor powders, protein e.g., whey protein, rice protein, soy protein and/or corn protein), food grade silica (e.g., $TiO_2$ and/or other inert edible powdered materials), encapsulated flavors and combinations thereof. Materials such as unencapsulated or encapsulated tobacco powder, fine cut tobaccos, and dry flavor powders are particularly advantageous, since they perform multiple functions in the moist smokeless tobacco product: they provide texturing to the pouch membrane surface, and they interact with the user's saliva to provide an initial flavor or chemesthetic experience when the oral pouch product is first introduced into the user's mouth.

In other embodiments, the powder component 20 can include dyes or pigments to provide a pleasing saliva color. Also, the powder component 20 can include saliva texture modifiers, such as proteolytic enzymes, which act to make saliva less viscous (e.g., bromelain, papain and/or other proteases).

EXAMPLE 4

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then about 0.02 g of cellulose powder ranging in size from about 10 mesh to about 500 mesh is sprinkled onto the surface of the super-hydrated membrane coating. The sample is then dried at room temperature to remove excess water from the coating.

EXAMPLE 5

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. About 2 g of cellulose powder ranging in size from about 10 mesh to about 500 mesh is added as the texture component to about 100 mL of the coating solution. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating including the powder component as the texture component. The sample is then dried at room temperature to remove excess water from the coating.

EXAMPLE 6

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then about 0.02 g of Starch 465 powder ranging in size from about 10 mesh to about 500 mesh (available from National Starch & Chemical Company) is sprinkled onto the surface of the super-hydrated membrane coating. The sample is then dried at room temperature to remove excess water from the coating.

EXAMPLE 7

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of Chi-Fi® 100FG powder ranging in size from about 10 mesh to about 500 mesh (available from Fiberstar, Inc.™) is sprinkled onto the surface of the super-hydrated membrane coating. The sample is then dried at room temperature to remove excess water from the coating.

EXAMPLE 8

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of Fibrex® 605 (available from Danisco A/C) powder ranging in size from about 10 mesh to about 500 mesh is sprinkled onto the surface of the super-hydrated membrane coating. The sample is then dried at room temperature to remove excess water from the coating.

EXAMPLE 9

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of rice protein powder ranging in size from about 10 mesh to about 500 mesh is sprinkled onto the surface of the super-hydrated membrane coating. The sample is then dried at room temperature to remove excess water from the coating.

EXAMPLE 10

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of soy protein powder ranging in size from about 10 mesh to about 500 mesh is sprinkled onto the surface of the super-hydrated membrane coating. The sample is then dried at room temperature to remove excess water from the coating.

EXAMPLE 11

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of food grade silica powder ranging in size from about 10 mesh to about 500 mesh is sprinkled onto the surface of super-hydrated membrane coating. The sample is then dried at room temperature to remove excess water from the coating.

EXAMPLE 12

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of tobacco powder ranging in size from about 10 mesh to about 500 mesh is sprinkled onto the surface of the super-hydrated membrane coating. The sample is then dried at room temperature to remove excess water from the coating.

EXAMPLE 13

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of encapsulated tobacco powder ranging in size from about 10 mesh to about 500 mesh is sprinkled onto the surface of the super-hydrated membrane. The sample is then dried at room temperature to remove excess water from the coating.

EXAMPLE 14

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the MST is then cross-linked with the 2.0 wt % cross-linking solution to form a shape of MST having a super-hydrated membrane coating. Then, about 0.02 g of fine cut snuff tobacco is sprinkled onto the surface of the super-hydrated membrane coating. The sample is then dried at room temperature to remove excess water from the coating.

EXAMPLE 15

About 1.5 g of moist smokeless tobacco is first molded into a predefined shape. The coating solution comprises about 4% pectin, about 0.15% alginate, about 4% dextrin and balance water, which is stirred and heated to about 50° C. to 100° C. to dissolve the biopolymers The solution is cooled down to room temperature and then transferred to a plastic pan. The molded shape of MST is then dipped into the above described solution. A cross-linking solution of 2.0 wt % calcium lactate in water is prepared. The coating on the moist smokeless tobacco is then cross-linked with the 2.0 wt % cross-linking solution to form a shape of MST having a super-hydrated membrane coating. Then, about 0.02 g of encapsulated biopolymer powder ranging in size from about 10 mesh to about 500 mesh (e.g., agar, starch derivatives, cellulose derivatives, chitosan, chitin, other natural proteins, food grade inert powdered materials, and/or encapsulated flavorants) is sprinkled onto the surface of the super-hydrated membrane coating to form. The sample is then dried at room temperature to remove excess water from the coating.

Figure 2:
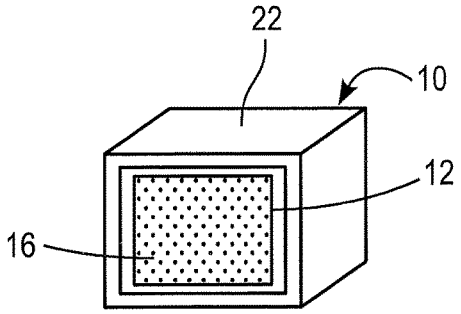
FIG. 2 is a cross-sectional view of a moist smokeless tobacco product with a semi-dissolvable, super-hydrated membrane coating having a second coating on an outer surface of the semi-dissolvable, super-hydrated membrane coating.

In a second embodiment, as shown in FIG. 2, the texture component comprises a polymer (second) layer 22, including at least one water-dissolvable polymer formed on a surface of the super-hydrated membrane coating 12. The polymer layer 22 can be flavored or unflavored. Preferably, the polymer layer 22 is applied onto an outer surface of the super-hydrated membrane coating 12 (first layer). Also preferably, the polymer layer 22 provides a water dissolvable membrane layer, which provides a desirable sticky texture that increases friction when the moist smokeless tobacco product 10 is placed in the user's mouth. Since the polymer layer is not cross-linked, the water soluble polymers used to form the polymer layer cause the second layer to be sticky, thereby increasing friction when placed in the mouth and creating texture on the surface of the MST product 10. The increased friction improves in-mouth control and the ability to place the product 10 in the mouth without worry about movement during use.

Suitable polymer layers 22 can be formed using a second coating solution comprising at least one polymer and water. Preferably, the polymer solutions comprises a water-soluble polymer. Preferred polymers include, without limitation, modified starch, dextrin, pullulan, pectin, and combinations thereof. The polymers can be included in the solution in an amount of about 0.1% to about 60% by weight based on the weight of the coating 22. As with the super-hydrated membrane coating 12, the concentration of the polymers in the second coating solution can affect the density of the polymer coating 22.

The second coating solution can be applied to the coated moist smokeless tobacco product by spraying or pouring the second solution onto the tobacco product or by dipping the tobacco product into the second solution.

In a preferred embodiment, the polymer coating 22 can include a flavorant. The flavorant can be the same or different from flavorants used in the first coating 12 or in the tobacco material 16. The flavorant can be included in the polymer coating 22 in an amount of about 0.1% to about 20% by weight based on the weight of the polymer coating 22.

In other embodiments, colorants can be added to the first and/or second coatings to color the product prior to placement in a user's mouth and to color spit during use.

After applying the polymer coating 22, the moist smokeless tobacco product 10 can be dried at room temperature or in a convection oven to remove excess moisture from the coatings 12, 22. However, it is preferred that the tobacco material 16 contained in the moist smokeless tobacco product 10 retain at least about 35% to about 65% moisture, and more preferably about 50% to about 55% moisture after drying.

EXAMPLE 16

About 1.5 g of moist smokeless tobacco is molded into a predefined shape and then dipped into a coating solution comprising about 4% pectin, 0.15% alginate and 4% dextrin. A cross-linking solution of 2.0 wt % calcium lactate in water is prepared. The coating on the moist smokeless tobacco is then cross-linked with the 2.0 wt % cross-linking solution to form a shape of MST having a super-hydrated membrane coating. A polymer coating is then formed on an outer surface of the super-hydrated membrane coating by dipping the coated MST into a second polymer solution comprising about 38% Purity Gum 59 (modified starch from National Starch & Chemical Company) or pouring the second polymer solution over the coated MST. The sample is then dried at room temperature to remove excess water from the coating.

EXAMPLE 17

About 1.5 g of moist smokeless tobacco is molded into a predefined shape and then dipped into a coating solution comprising about 4% pectin, 0.15% alginate and 4% dextrin. A cross-linking solution of 2.0 wt % calcium lactate in water is prepared. The coating on the moist smokeless tobacco is then cross-linked with the 2.0 wt % cross-linking solution to form a shape of MST having a super-hydrated membrane coating. A polymer coating is then formed on an outer surface of the super-hydrated membrane coating by dipping the coated MST into a second polymer solution comprising about 50% dextrin or pouring the second polymer solution over the coated MST. The sample is then dried at room temperature to remove excess water from the coating.

EXAMPLE 18

About 1.5 g of moist smokeless tobacco is molded into a predefined shape and then dipped into a coating solution comprising about 4% pectin, 0.15% alginate and 4% dextrin. A cross-linking solution of 2.0 wt % calcium lactate in water is prepared. The coating on the moist smokeless tobacco is then cross-linked with the 2.0 wt % cross-linking solution to form a shape of MST having a super-hydrated membrane coating. A polymer coating is then formed on an outer surface of the super-hydrated membrane coating by dipping the coated MST into a second polymer solution comprising about 17% pullulan or pouring the second polymer solution over the coated MST. The sample is then dried at room temperature to remove excess water from the coating.

EXAMPLE 19

About 1.5 g of moist smokeless tobacco is molded into a predefined shape and then dipped into a coating solution comprising about 4% pectin, 0.15% alginate and 4% dextrin. A cross-linking solution of 2.0 wt % calcium lactate in water is prepared. The coating on the moist smokeless tobacco is then cross-linked with the 2.0 wt % cross-linking solution to form a shape of MST having a super-hydrated membrane coating. A polymer coating is then formed on an outer surface of the super-hydrated membrane coating by dipping the coated MST into a second polymer solution comprising about 4% low molecular weight pectin (e.g., a pectin having a molecular weight of about 500 to about 5000 Mw) or pouring the second polymer solution over the coated MST. The sample is then dried at room temperature to remove excess water from the coating.

EXAMPLE 20

About 1.5 g of moist smokeless tobacco is molded into a predefined shape and then dipped into a coating solution comprising about 4% pectin, 0.15% alginate and 4% dextrin. A cross-linking solution of 2.0 wt % calcium lactate in water is prepared. The coating on the moist smokeless tobacco is then cross-linked with the 2.0 wt % cross-linking solution to form a shape of MST having a super-hydrated membrane coating. A polymer coating is then formed on an outer surface of the super-hydrated membrane coating by dipping the coated MST into a second polymer solution comprising about 17% pullulan and a strawberry flavorant in an amount effective to flavor the coating. The sample is then dried at room temperature to remove excess water from the coating.

In a third embodiment, the texture component added to the super-hydrated membrane coating can be a pre-cross-linking agent. Suitable pre-cross-linking agents include, without limitation, cross-linking agents described above and used to form the insoluble component (in an outward to inward direction) of the super-hydrated membrane coating.

To pre-cross-link the super-hydrated membrane coating, a pre-cross-linking agent can be added to the first coating solution (the coating solution used to form the super-hydrated membrane coating 12). While the super-hydrated membrane coating 12 is cross-linked after formation, due to the fast rate of gelation between the cross-linkable polymer and the cross-linking agent, it is believed that the cross-linking agent may not be able to diffuse through the thickness of the coating, thereby leaving the internal portion uncross-linked. The lack of full cross-linking throughout the membrane coating can cause weak membrane and increased slipperiness of the product.

Thus, by including a pre-cross-linking agent in the coating solution, cross-linking initially occurs from an inward to outward direction. The later addition of a second cross-linking agent after formation of the membrane coating provides cross-linking in the outward to inward direction. Thus, the membrane coating is fully cross-linked to form a stronger and less slippery (less soluble) coating.

EXAMPLE 21

About 1.5 g of moist smokeless tobacco is first molded into a predefined shape. The MST is then dipped into a 90° C. solution comprising about 4% pectin and about 0.5% calcium lactate as the pre-cross-linking agent. After removing the sample from the solution and cooling, the sample is dried at room temperature to remove excess water from the coating.

EXAMPLE 22

About 1.5 g of moist smokeless tobacco is first molded into a predefined shape. The MST is then dipped into a 90° C. solution comprising about 4% alginate and about 0.5% calcium lactate as the pre-cross-linking agent. After removing the sample from the solution and cooling, the sample is dried at room temperature to remove excess water from the coating.

EXAMPLE 23

About 1.5 g of moist smokeless tobacco is first molded into a predefined shape. The MST is then dipped into a 90° C. solution comprising about 4% pectin and about 0.5% calcium lactate as the pre-cross-linking agent. A cross-linking solution of 2.0 wt % calcium lactate in water was prepared. The coating on the moist smokeless tobacco is then cross-linked with the 2.0 wt % cross-linking solution. After removing the sample and cooling, the sample is dried at room temperature to remove excess water from the coating.

EXAMPLE 24

About 1.5 g of moist smokeless tobacco is first molded into a predefined shape. The MST is then dipped into a 90° C. solution comprising about 4% agar and about 0.5% calcium lactate as the pre-cross-linking agent. After removing the sample and cooling, the sample is dried at room temperature to remove excess water from the coating.

In a fourth embodiment, the texture component is added to the super-hydrated membrane coating 12 in the form of fibers, cords and/or strips within, under and/or on an outer surface of the super-hydrated membrane coating 12. The fibers, cords and/or strips can be applied to the super-hydrated membrane coating 12 before and/or after drying. Preferably, the fibers, cords and/or strips can be placed around the molded moist smokeless tobacco material prior to coating and/or during coating. For example, the fibers, cords and/or strips may be added to the coating solution so that when the MST is coated, the fibers, cords and/or strips adhere to the MST along with the super-hydrated membrane coating. Alternatively, the fibers, cords and/or strips can be placed around the moist smokeless tobacco product after formation of the super-hydrated membrane coating.

In an embodiment, the fibers, cords and/or strips can be affixed to the moist smokeless tobacco product 10 using a food-grade adhesive. Suitable food-grade adhesives can include at least one polymer. In other embodiments, the super-hydrated membrane coating 12 can aide in affixing the fibers, cords and/or strips to the tobacco product 10. After affixing the fibers, cords and/or strips to the MST product, the MST product can be coated. Alternatively, the fibers, cords and/or strips can be affixed after coating.

In a preferred embodiment, the fibers, cords and/or strips are formed of tobacco fibers, vegetable fibers, fruit fibers, herb fibers, synthetic polymers, and/or natural polymers, Suitable synthetic polymers for use in forming particles, fibers, cords and/or strips include, without limitation, polyethylene, polypropylene, nylon, polyvinyl alcohol, polyethylene tetrapthalate, poly(ethylene-co-vinyl alcohol), polylactide, polyglycolic acid, polyethylene glycol, polycaprolactone and polyhydroxyalkanoate, Suitable natural polymers for use in forming particles, fibers, cords and/or strips include, without limitation, starch, cellulose, pectin, alginate and the like.

Figure 3:
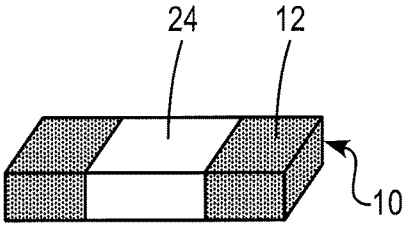
FIG. 3 is a perspective view of a first embodiment of a moist smokeless tobacco product with a semi-dissolvable, super-hydrated membrane coating having a single fiber, cord and/or strip forming part of the outer surface of the semi-dissolvable, super-hydrated membrane coating.
Figure 4:
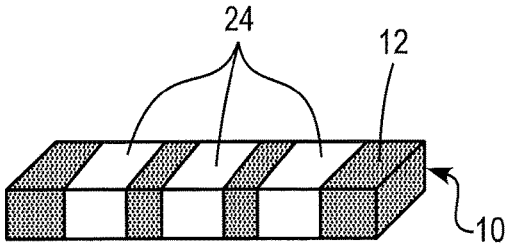
FIG. 4 is a perspective view of a second embodiment of a moist smokeless tobacco product with a semi-dissolvable, super-hydrated membrane coating having multiple fibers, cords and/or strips forming part of the outer surface of the semi-dissolvable, super-hydrated membrane coating.
Figure 5:
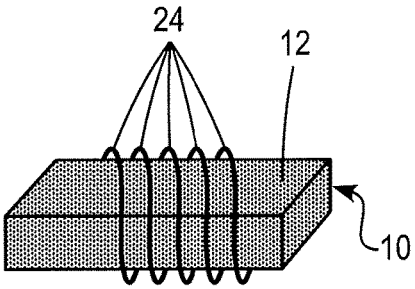
FIG. 5 is a perspective view of a third embodiment of a moist smokeless tobacco product with a semi-dissolvable, super-hydrated membrane coating having a thin fiber, cord and/or strip wrapped around the moist smokeless tobacco product and forming part of the outer surface of the semi-dissolvable, super-hydrated membrane coating.

As shown in FIG. 3, the tobacco product 10 can include a single fiber, cord and/or strip 24. As shown in FIGS. 4 and 5, the tobacco product can include multiple fibers, cords and/or strips.

The fibers, cords and/or strips can be formed of various widths and lengths. For example, the fibers, cords and/or strips can have a width and/or a length ranging from about 0.01 mm to about 5.0 mm. In addition, the fibers, cords and/or strips can be placed across the tobacco product on a single side or on multiple sides. The fiber cords and/or strips can lay diagonally across the tobacco product 10 or straight across the length and/or width of the tobacco product 10. In an embodiment, fiber cords and/or strips are arranged in multiple directions over the surface of the super-hydrated membrane coating. In other embodiments, the fiber cords and/or strips are placed in a uniform and/or random position on the surface of the super-hydrated membrane coating. In an embodiment, the fibers, cords and/or strips can form a pattern on the surface of the moist smokeless tobacco product 10.

Figure 6:
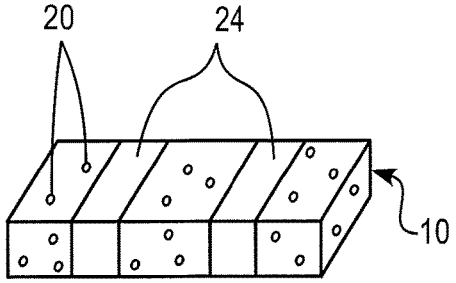
FIG. 6 is a perspective view of a fourth embodiment of a moist smokeless tobacco product with a semi-dissolvable, super-hydrated membrane coating having a powdered surface coating and multiple fibers cords and/or strips forming part of the outer surface of the semi-dissolvable, super-hydrated membrane coating.

In other embodiments, the tobacco product 10 can include multiple texture components. For example, as shown in FIG. 6, the tobacco product 10 can include a powder component 20 and fibers, cords and/or strips 24. Alternatively, the tobacco product 10 can include a second coating layer, powder and/or fibers, cords and/or strips. In yet another embodiment, the tobacco product 10 can include pre-cross-linking, a second coating, a powder component and/or fibers, cords and/or strips.

In this specification, the word "about" is often used in connection with numerical values to indicate that mathematical precision of such values is not intended. Accordingly, it is intended that where "about" is used with a numerical value, a tolerance of 10% is contemplated for that numerical value.

While the foregoing describes in detail moist smokeless tobacco products and methods of forming moist smokeless tobacco products with reference to specific embodiments thereof, it will be apparent to one skilled in the art that various changes and modifications and equivalents to the moist smokeless tobacco products and methods of forming moist smokeless tobacco products may be employed, which do not materially depart from the spirit and scope of the invention.

What is claimed is:

1. A moist smokeless tobacco product for oral use comprising:

a shaped piece of tobacco material including a semi-dissolvable, super-hydrated membrane coating that is coated on a portion an outer surface of the shaped piece of tobacco material, the semi-dissolvable, super-hydrated membrane coating comprising:

(a) a soluble, non-cross-linked component; and (b) an insoluble, cross-linked component;

wherein the insoluble, cross-linked component of the semi-dissolvable, super-hydrated membrane coating is configured to create a porous network after the soluble, non-cross-linked component dissolves in a user's mouth during oral use of the moist smokeless tobacco product; and a first texture component, wherein the first texture component comprises a powder component within, under, and/or on the semi-dissolvable, super-hydrated membrane coating, the powder component comprising one or more powders;

wherein the powder component increases friction between an outer surface of the moist smokeless tobacco product and a user's mouth during oral use of the moist smokeless tobacco product.

2. The moist smokeless tobacco product of claim 1, wherein said soluble, non-cross-linked component comprises a non-cross-linkable polymer selected from the group consisting of starch, dextrin, gum arabic, guar gum, chitosan, cellulose, polyvinyl alcohol, polylactide, gelatin, soy protein, whey protein and combinations thereof.

3. The moist smokeless tobacco product of claim 1, wherein said insoluble, cross-linked component comprises a cross-linking agent and a cross-linkable polymer selected from the group consisting of alginate, pectin, carrageenan, modified polysaccharides with cross-linkable functional groups and combinations thereof.

4. The moist smokeless tobacco product of claim 3, wherein said cross-linkable polymer is a chemically cross-linkable polymer.

5. The moist smokeless tobacco product of claim 1, wherein (a) the semi-dissolvable, super-hydrated membrane coating and/or said tobacco material further comprises at least one additive selected from the group consisting of flavorants, sweeteners, preservatives, nutraceuticals, antioxidants, amino acids, minerals, vitamins, botanical extracts, humectants, colorants, chemesthetic agents and combinations thereof and/or (b) the tobacco material further comprises a supplemental amount of tobacco substitute material selected from the group consisting of fruit fibers and particles, vegetable fibers and particles, plant fibers and particles and combinations thereof to the tobacco material.

6. The moist smokeless tobacco product of claim 1, wherein the tobacco material is completely disintegrable in the mouth.

7. The moist smokeless tobacco product of claim 1, wherein the tobacco material comprises moist smokeless tobacco having a moisture content of about 35% to about 65%.

8. The moist smokeless tobacco product of claim 1, wherein the tobacco material comprises moist smokeless tobacco having a water activity of about 0.85 aw to about 0.86 aw.

9. The moist smokeless tobacco product of claim 1, further comprising a second texture component wherein the second texture component comprises at least one strip that increases friction between the outer surface of the moist smokeless tobacco product and a user's mouth during oral use of the moist smokeless tobacco product.

10. The moist smokeless tobacco product of claim 1, wherein the bulk density of the super-hydrated membrane coating is about 1.0±0.2 g/cm$^3$.

11. The moist smokeless tobacco product of claim 1, wherein the shaped piece of tobacco material has a length of up to about 1.5 inch, a width of up to about 0.75 inch and a height of up to about 1 inch and wherein the shaped of tobacco material weighs about 0.5 g to about 3.0 g.

12. The moist smokeless tobacco product of claim 1, wherein the semi-dissolvable, super-hydrated membrane coating has a moisture content of about 10% to about 50%.

13. The moist smokeless tobacco product of claim 1, wherein the soluble, non-cross-linked component and the insoluble, cross-linked component are dissolved in water and/or tobacco juices.

14. A method of making a moist smokeless tobacco product comprising:

coating a portion of an outer surface of a shaped piece of tobacco material with a semi-dissolvable super-hydrated membrane coating comprising a soluble, non-cross-linked component; and an insoluble, cross-linked component;

drying the semi-dissolvable super-hydrated membrane coating; and adding a first texture component to the moist smokeless tobacco product before, during, and/or after the drying of the semi-dissolvable super-hydrated membrane coating, wherein the first texture component is a powder component within, under, and/or on the semi-dissolvable super-hydrated membrane coating, the powder component including one or more powders, wherein the powder component increases friction between an outer surface of the moist smokeless tobacco product and a user's mouth during oral use of the moist smokeless tobacco product.

15. The method of claim 14, wherein the drying of the semi-dissolvable, super-hydrated membrane coating releases water from the semi-dissolvable, super-hydrated membrane coating, such that juices of the tobacco material enter the semi-dissolvable, super-hydrated membrane coating.

16. The moist smokeless tobacco product of claim 1, wherein said shaped piece of tobacco material is in the configuration of a rectangle that weighs about 2.5 to 3.0 g.

17. The method of claim 14, wherein the shaped piece of tobacco material is in the configuration of a rectangle that weighs about 2.5 to 3.0 g.

18. The moist smokeless tobacco product of claim 1, wherein the powder component includes a saliva texture modifier including a proteolytic enzyme.

19. The moist smokeless tobacco product of claim 18, wherein the proteolytic enzyme is bromelain, papain, or a combination of bromelain and papain.

20. The moist smokeless tobacco product of claim 1, wherein:

(a) the powder component is included in an amount of about 0.01 g to about 5 g;

(b) the size of individual particles of the one or more powders is about 500 mesh to about 10 mesh;

(c) the one or more powders of the powder component are held together by a binder;

(d) the powder component includes dyes or pigments configured to provide a pleasing saliva color;

(e) the shaped piece of tobacco material has a sphere, rectangle, oblong, crescent shape, oval, or cube shape;

(f) the outer surface of the semi-dissolvable, super-hydrated membrane coating includes at least one water-dissolvable polymer layer; and/or (g) the semi-dissolvable, super-hydrated membrane coating includes at least one pre-cross-linking agent.

21. The moist smokeless tobacco product of claim 1, wherein the one or more powders of the powder component include:

(a) at least one powder selected from the group consisting of powders of natural plant fibers, herb fibers, water-insoluble synthetic fibers, dietary fibers, fruit fibers, vegetable fibers, fibers of water-insoluble hydrophilic biopolymers, and fibers of silica;

(b) at least one powder selected from the group consisting of powders of water-insoluble hydrophilic biopolymers particles, silica particles, polyethylene particles, polypropylene particles, nylon particles, polyvinyl alcohol particles, polyethylene tetrapthalate particles, poly(ethylene-co-vinyl alcohol) particles, polylactide particles, polyglycolic acid particles, polyethylene glycol particles, polycaprolactone particles, and polyhydroxyalkanoate particles;

(c) at least one powder selected from the group consisting of powders of agar, starch, starch derivatives, cellulose, cellulose derivatives chitosan, and chitin; and/or (d) at least one powder selected from the group consisting of powders of whey protein, rice protein, soy protein, and corn protein.

22. The moist smokeless tobacco product of claim 21, wherein the powder component further includes:

(a) at least one tobacco powder selected from the group consisting of unencapsulated tobacco powder, encapsulated tobacco powder, tobacco dust, encapsulated tobacco dust, and/or fine cut tobacco; and/or (b) at least one flavorant, encapsulated flavorant, dry flavor powder; and/or water-insoluble dry flavor powder.

23. The moist smokeless tobacco product of claim 1, wherein the semi-dissolvable, super-hydrated membrane coating coats the entire shaped piece of tobacco material so as to fully enclose the shaped piece of tobacco material.

24. The method of claim 14, further comprising:

(a) shaping the shaped piece of tobacco material into a sphere, rectangle, oblong, crescent, oval or cube shape prior to coating the shaped piece of tobacco material;

(b) coating the entire shaped piece of the tobacco material;

(c) adding a polymer layer on an outer surface of the semi-dissolvable, super-hydrated membrane coating comprising at least one water-dissolvable coating; and/or (d) adding at least one pre-cross-linking agent to the semi-dissolvable, super-hydrated membrane coating.

25. The method of claim 14, further comprising adding a second texture component to the moist smokeless tobacco product before, during, and/or after the drying of the semi-dissolvable super-hydrated membrane coating, wherein the second texture component comprises at least one strip that increases friction between the outer surface of the moist smokeless tobacco product and a user's mouth during oral use of the moist smokeless tobacco product.

* * * * *